US008415578B2

(12) United States Patent
Hunger et al.

(10) Patent No.: US 8,415,578 B2
(45) Date of Patent: Apr. 9, 2013

(54) CIRCUIT BREAKER WITH A GEAR HAVING A DEAD POINT

(75) Inventors: Olaf Hunger, Schaffhausen (CH); Jürg Nufer, Niederhasli (CH)

(73) Assignee: ABB Technology AG, Zurich (CH)

( * ) Notice: Subject to any disclaimer, the term of this patent is extended or adjusted under 35 U.S.C. 154(b) by 846 days.

(21) Appl. No.: 12/000,185

(22) Filed: Dec. 10, 2007

(65) Prior Publication Data

US 2008/0135526 A1 Jun. 12, 2008

(30) Foreign Application Priority Data

Dec. 11, 2006 (EP) ..... 06405511

(51) Int. Cl.
*H01H 33/90* (2006.01)

(52) U.S. Cl.
USPC ..... 218/78; 218/7; 218/154

(58) Field of Classification Search ..... 218/3–7, 218/14, 43, 45, 67, 71, 78–80, 84, 153, 154
See application file for complete search history.

(56) References Cited

U.S. PATENT DOCUMENTS

| | | | | |
|---|---|---|---|---|
| 3,896,282 | A | 7/1975 | Chabala | |
| 6,342,685 | B1 * | 1/2002 | Perret | 218/78 |
| 6,365,863 | B1 * | 4/2002 | Marin et al. | 218/43 |
| 7,507,932 | B2 * | 3/2009 | Hunger et al. | 218/78 |

FOREIGN PATENT DOCUMENTS

| | | | |
|---|---|---|---|
| DE | 196 31 323 | C1 | 10/1997 |
| DE | 100 03 357 | C1 | 7/2001 |
| EP | 0 809 269 | A2 | 11/1997 |
| EP | 0 809 269 | B1 | 11/1997 |
| EP | 0 822 565 | A2 | 2/1998 |
| EP | 0 822 565 | B1 | 2/1998 |
| EP | 1 630 840 | A1 | 3/2006 |

* cited by examiner

*Primary Examiner* — Amy Cohen Johnson
*Assistant Examiner* — Marina Fishman
(74) *Attorney, Agent, or Firm* — Buchanan Ingersoll & Rooney PC

(57) ABSTRACT

An electrical circuit breaker has a first contact piece which can be moved in a first movement range along a switching axis and has an arcing contact, a second contact piece which can move along the switching axis and which has a further arcing contact, a drive for moving the first contact piece and a gear for transferring the movement of the first contact piece to the second contact piece. The gear has a first dead point which is passed through on the output drive side by the gear during the movement of the first contact piece in the first movement range.

40 Claims, 10 Drawing Sheets

CIRCUIT BREAKER WITH A GEAR HAVING A DEAD POINT

RELATED APPLICATION

This application claims priority under 35 U.S.C. §119 to European Patent Application No. 06405511.4 filed in the European Patent Office on 11 Dec. 2006, the entire contents of which are hereby incorporated by reference in their entireties.

TECHNICAL FIELD

The present disclosure relates in general to electrical circuit breakers, and in particular to electrical circuit breakers with a double drive. The disclosure also relates to methods for contact disconnection in an electrical circuit breaker.

BACKGROUND INFORMATION

Switches in which an arcing contact for example a quenching tulip, are moved away from a further arcing contact, for example, a pin, in order to disconnect an electrical connection are known from the prior art. Switches are also known in which two arcing contacts are moved in opposite directions.

By way of example, EP 0 809 269 discloses a high-voltage circuit breaker having two movable arcing contact pieces which are coaxially opposite one another. A drive rod is mounted to the insulating material nozzle and drives the opposite arcing contact piece via a two-armed lever arranged on the switch axis.

U.S. Pat. No. 3,896,282 discloses a load interrupter with two contacts which can move in opposite directions and are arranged in an enclosure filled with inert gas. The contacts are connected by means of a lever transmission or lever gear which comprises a two-armed lever arranged on the switch axis and has connecting rods articulated on both sides.

The disclosure makes reference to EP 0 822 565, which discloses a gas-blast circuit breaker with two contact pieces which can be moved in opposite senses. The contact pieces are coupled to one another via the insulating material nozzle and a lever mechanism. The lever mechanism comprises a two-armed direction-changing lever which is arranged on the switch axis and has connecting rods articulated on both sides.

DE 100 03 359 C1 discloses a high-voltage circuit breaker having a drive which drives a first arcing contact piece and an auxiliary drive, which drives a second arcing contact piece. The auxiliary drive comprises three two-armed levers and is designed such that the movement direction of the second arcing contact piece which can be driven is reversed once or twice during a disconnection process.

The known switches from the prior art cause, however, a movement of the contacts which are not ideally matched to one another in various respect. Furthermore, gears or transmissions for these switches can in some cases be implemented only by occupying a considerable amount of space which is disadvantageous, especially in the case of gas-blast circuit breakers.

SUMMARY

The object of the present disclosure is to specify an improved double drive for a circuit breaker. An electrical circuit breaker is disclosed.

An electrical circuit breaker is disclosed, having a first contact piece with a first arcing contact, a second contact piece with a second arcing contact, a drive for moving the first contact piece in a first movement range along a switching axis and a gear for transferring the movement of the first contact piece to a movement of the second contact piece, with the first movement range comprising a contact-subrange and a disconnecting-subrange and with the arcing contacts making contact with one another when the first contact piece is in the contact-subrange, and with the arcing contacts being disconnected from one another when the first contact piece is in the disconnecting-subrange, wherein the gear has a first dead point which is passed through during the movement of the first contact piece in the contact-subrange.

A method for contact disconnection of an electrical circuit breaker is disclosed, which has a first contact piece with a first contact, a second contact piece with a second contact and a gear and which, in particular, has a circuit breaker, with the method having the following steps: the first contact piece is moved in a disconnection direction along a switching axis, the gear transfers the movement of the first contact piece to a movement of the second contact piece along the switching axis and the first contact and the second contact are disconnected from one another by the movement of the contact pieces wherein the movement of the second contact piece changes direction at least once before disconnection of the contacts.

BRIEF DESCRIPTION OF THE DRAWINGS

Exemplary embodiments of the disclosure will be described in more detail in the following text and are illustrated in the figures, which show in.

DETAILED DESCRIPTION

Figure 1:
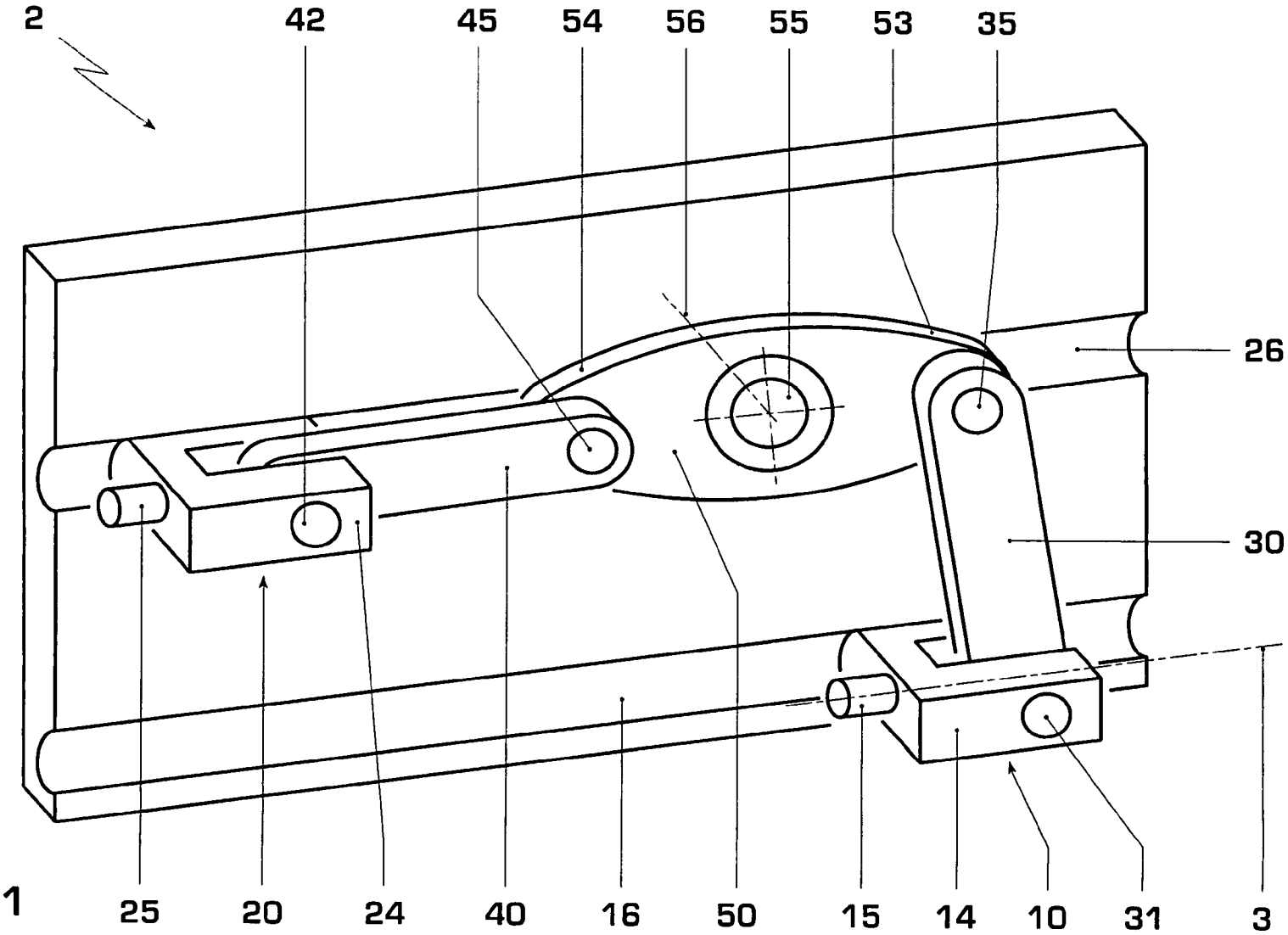
FIG. 1 a perspective view of a part of a circuit breaker according to the disclosure.

According to a first aspect of the disclosure, an electrical circuit breaker with a specific double movement of the contacts is made available. The circuit breaker comprises a first switching piece, typically with a first arcing contact, in particular a tulip, and a second contact piece typically with a second arcing contact, in particular a pin. The circuit breaker furthermore comprises a drive for moving the first contact piece in a first movement range along a switching axis, that is to say essentially parallel to or anti-parallel to the switching axis, in particular relative to an enclosure, and a gear for transferring the movement of the first contact piece to a movement of the second contact piece. The first movement range comprises a contact-subrange and a disconnecting-subrange. The arcing contacts make contact with one another, that is to say a mechanical and electrical contact is provided, when the first contact piece is in the contact-subrange, and they are mechanically disconnected from one another, that is to say this situation occurs when the first contact piece is in the disconnecting-subrange. The gear has a first dead point which is passed through in the contact-subrange during the movement of the first contact piece, which movement in particular is in the direction along the switching axis. In particular, the gear parts are dimensioned and arranged such that the first dead point is passed through.

A dead point occurs when the second contact piece essentially does not move during movement of the first contact piece. A dead point actually occurs when this condition is satisfied for (infinitesimally) small movements of the first contact piece around a position in the first movement range, that is to say to a linear approximation. A dead point, therefore, occurs when the first derivative of a movement curve, such as that shown in FIG. 3*b*, disappears. In particular, reversal points of the gear, that is to say, extremes of the movement curve, are dead points. A gear dead point is generally also a dead point of the gear part or gear articulation. A dead point such as this of a gear part or a gear articulation occurs when there is essentially no movement of the gear part or gear articulation during movement of the gear part which immediately precedes it on the drive side.

The first dead point in some exemplary embodiments is a reversal point for the pivoting or swiveling movement of, e.g., a two-armed lever around its lever axis. The first dead point in some embodiments is also characterized by the (input) drive rod and the switching axis being essentially at right angles.

According to a further aspect of the disclosure, a method is provided for opening the contacts of an electrical circuit breaker, that is to say in particular for disconnecting its arcing contacts. The circuit breaker has a first contact piece with a first contact, in particular an arcing contact, a second contact piece with a second contact, in particular an arcing contact and a gear. The method has the following steps: the first contact piece is in a disconnection direction moved along a switching axis; the gear transfers the movement of the first contact piece to a movement, which in particular is associated with it, of the second contact piece along the switching axis; and the first contact and the second contact are disconnected from one another by the movement of the contact pieces. The movement, which in particular is associated, of the second contact piece changes direction at least once before disconnection of the contacts, in some embodiments even at least two or three times, in particular in that the first dead point of the gear is passed.

In some exemplary embodiments, the movement of the first contact piece comprises an acceleration phase followed by a movement phase, e.g., at an essentially constant speed, and the movement of the second contact piece comprises an initial acceleration which lasts until the at least one, two or three direction changes have been completed, followed by an acceleration phase, which is characterized by the second contact piece speed being up to about 50% of its maximum speed, followed by a movement phase. The acceleration phase of the second contact piece generally starts only after the end of an analogously defined acceleration phase of the first contact piece. The arcing contacts in some embodiments are disconnected only after the end of the acceleration phase of the second contact piece.

One aspect of a dead point in the contact-subrange is that the speed of the second contact piece before contact disconnection can be kept low, at least temporarily. A high-speed movement of the second contact piece can, in some embodiments of the disclosure, be restricted to a time period in which a movement such as this is advantageous or necessary (in general only after contact disconnection). This makes it possible to use drive energy efficiently, and to save physical space. Wear caused by friction can also be reduced. This also applies in a corresponding manner to the opposite movement during closing of the contact between the contact pieces.

The disclosure also relates to an apparatus for carrying out the disclosed methods, and also comprises apparatus parts for carrying out respective individual method steps. By way of example, the disclosure also relates to a gear for installation and/or for use in a circuit breaker.

FIG. 1 shows a perspective view of a gear 2 of a circuit breaker according to the disclosure. The circuit breaker is typically a gas-blast circuit breaker, as is used, by way of example, in high-voltage systems. It typically has at least a number of common components of such a circuit breaker, such as an enclosure filled with inert gas, a pair of contacts and in particular arcing contacts, and possibly a pair of rated current contacts. One of the arcing contacts is generally in the form of a tulip, and the other of a pin. The arcing contacts can be moved with respect to one another along a switching axis. The switching axis 3 is typically a center axis 3, around which the arcing contacts 12, 22 are arranged coaxially.

In order to disconnect an electrical contact, the tulip and pin can be moved away from one another along the switching axis 3. For this purpose, a first contact piece with a first arcing contact 12, which is typically the tulip, can be driven by a drive. In order to drive the second contact piece 20 with the second arcing contact 22, typically the pin, the movement of the first contact piece 10 is transferred to the second contact piece 20 by means of a gear 2.

FIG. 1 shows a part of the first contact piece 10, which comprises a first sliding element 14. The first sliding element 14 can be moved by means of a rail 16 along the switching axis 3, and can be coupled by a coupling 15 to the rest of the first contact piece 10 with the first arcing contact (not illustrated). In a corresponding manner, the second contact piece 20 also has a second sliding element 24, a rail 26 and a coupling 25.

The gear 2 is illustrated in FIG. 1 in a movement state which corresponds to a closed circuit breaker, that is to say in which the first arcing contact 12 and the second arcing contact 22 are in contact with one another. The expression "contact" means a mechanical or direct electrical contact. Conversely, it is to be understood that the arcing contacts 12, 22 are not in "contact" with one another when, for example, only an arc is just burning between them. In the state illustrated in FIG. 1, the first contact piece 10 has been moved to the maximum extent to the right along the switching axis 3. The first contact piece 10 can be moved in a first movement range along the rail 16, with this movement range extending to the left along the switching axis 3 from the illustrated position of the first contact piece 10. A stop (not illustrated) optionally limits further movement of the first contact piece 10 to the right. A further stop (not illustrated) optionally limits the movement of the first contact piece 10 to the left beyond the first movement range.

The second contact piece 20 can also be moved along the rail 26 in a second movement range. As described in more detail in FIG. 2*b*, the second movement range extends from the position of the second contact piece 20 illustrated in FIG. 1 along the switching axis 3 both to the right and, to a small extent, to the left.

The gear 2 furthermore comprises an input drive rod 30, an output drive rod 40 and a lever 50. The lever 50 is mounted in a fixed position relative to the enclosure of the circuit breaker by means of a lever joint 55 and can pivot around a lever axis 56. The lever 50 has an input drive lever arm 53 and an output drive lever arm 54. The expressions "drive" and "output drive" relate to parts of the gear 2 which are arranged on the drive side and on the output drive side of one another or of the lever joint 55 or the lever axis 56. The input drive rod 30 is articulated on the first contact piece 10 such that it can rotate by means of a swiveling-joint or rotating joint 31, and is articulated on the drive lever arm 50 by means of a further swiveling-joint or rotating joint 35. The output drive rod is articulated in a corresponding manner in rotatable fashion on the second contact piece 20 on the output drive lever arm 54 by means of swiveling-joints 42, 45.

The lever 50 can be a two-armed or two-sided lever, that is to say the lever arms 53 and 54 are located on different, e.g., mutually opposite sides of the lever axis 56. Irrespective of the illustrated embodiment, there is typically an angle of more than 90° between the input drive lever arm 53 and the output drive lever arm 54, that is to say between the swiveling-joints 35, 55 (or the axis 56) and 55, 45. As can be seen from the illustration of the lever 50 in FIG. 2*a*, the lever arms 53 and 54 are typically bent, i.e. they are different from an angle of 180° so that the joints or articulations 35 and 45 generally do not lie on a common straight line with the lever axis 56.

The swiveling-joints 31, 35, 42 and 45 typically have only one degree of freedom for rotation about one rotation axis. Typically, they have no further degree of freedom, for example, for a linear movement.

Irrespective of the illustrated embodiment, the gear 2 is asymmetric. In particular, at least one of the following conditions is typically satisfied:

- the lever arms 53, 54 have different lengths;
- the arcing contact 12 of the first contact piece 10 and the arcing contact 22 of the second contact piece 20 are arranged coaxially around the switching axis 3, and the lever axis 56 is arranged radially offset with respect to the switching axis 3; or
- the radial distance (i.e. the distance at right angles to the switching axis 3) between the lever axis 56 and the swiveling-joint 31, by means of which the input drive rod 30 is articulated on the first contact piece 10 and the radial distance between the lever axis 56 and the swiveling-joint 42, by means of which the output drive rod 40 is articulated on the second contact piece 20, are chosen to be different;
- further conditions will be mentioned following the description of FIG. 3.

The lever axis 56 is generally offset with respect to the center axis 3, around which the arcing contacts 12, 22 are arranged coaxially. This makes it possible to increase the output drive movement, i.e. the movement range of the second contact piece 20, for a predetermined input drive movement, i.e. the movement range of the first contact piece 10. Conversely, the offset between the lever axis 56 and the center axis 3 can be used to reduce the input drive movement for a predetermined output drive movement. This allows the design to be physically compact.

The gear illustrated in FIG. 1 may be modified in various ways. In particular, the rods or connecting levers 30, 40, the lever 50 and the slides 10, 20 can be reconfigured arbitrarily or as required, and/or can be replaced by parts with a similar function. For example, the rails 16, 26 may also be replaced by other guides, for example by holes; and the two-armed lever 50 may be replaced by a single-armed lever.

FIG. 2*a* to FIG. 2*f* show schematic side views of movement states during the opening of the contacts of the circuit breaker 1 shown in FIG. 1. In addition to the elements in FIG. 1 an enclosure 7 is also indicated here. Furthermore, the first arcing contact 12 is illustrated as a tulip 12, and the second arcing contact 22 is illustrated schematically as a pin 22.

Figure 2A:
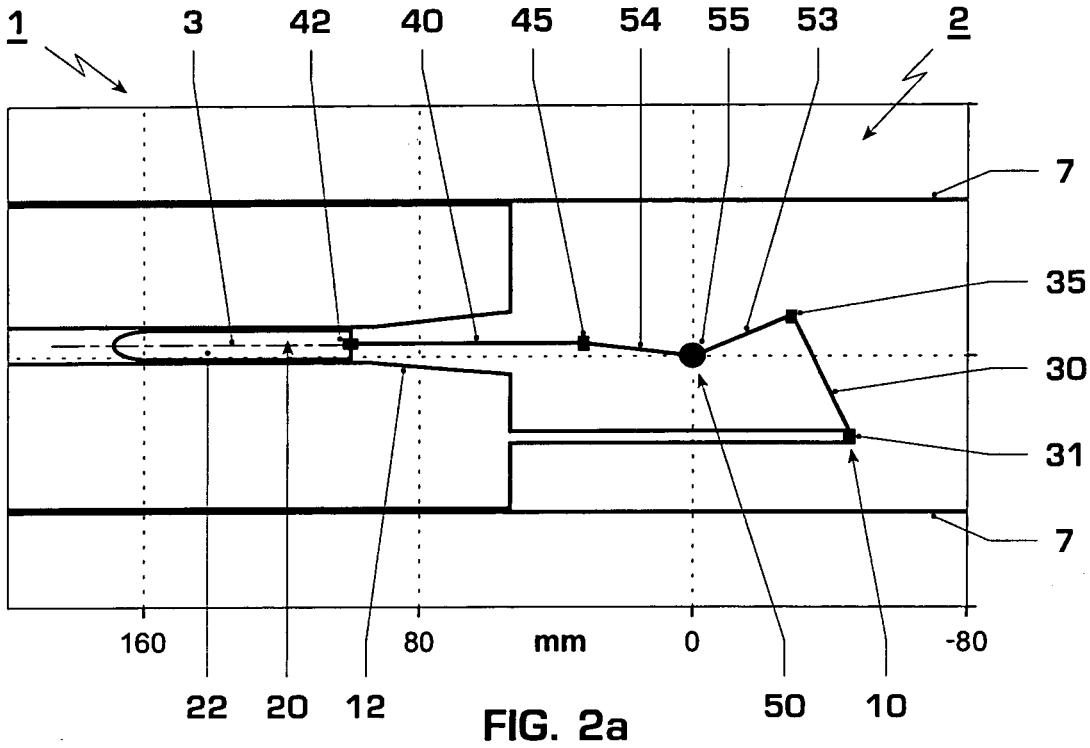
FIGS. 2*a*-2*f* movement states during contact opening of a circuit breaker according to the disclosure.

FIG. 2*a* shows the gear 2 in the same movement state as in FIG. 1, corresponding to a closed circuit breaker 1. This shows the first contact piece 10 on the right-hand edge of the first movement range, and the second contact piece 20 close to the left-hand edge of the second movement range. The output drive rod 40 and the output drive lever arm 54 do not form an extended angle but are close to it, for example, being down to less than 10°.

Figure 2B:
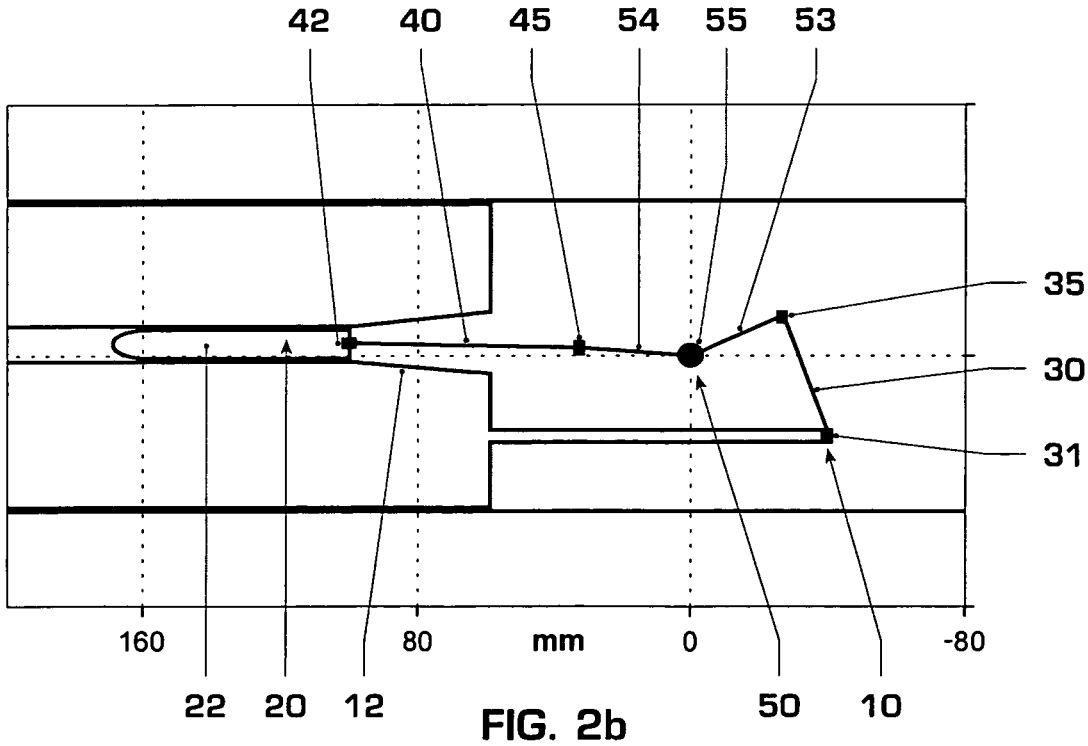

FIG. 2*b* shows the gear 2 after the first contact piece 10 has been moved a small distance to the left by the drive. This movement results in the lever 50 being rotated counterclockwise by means of the input drive rod 30 such that the output drive lever arm 54 and the output drive rod 40 now form an extended angle, that is to say a 180° angle. The extended angle results in the second contact piece 20 being moved or shifted to the maximum deflection position to the left, that is to say to the left-hand edge of the second movement range.

Figure 2C:
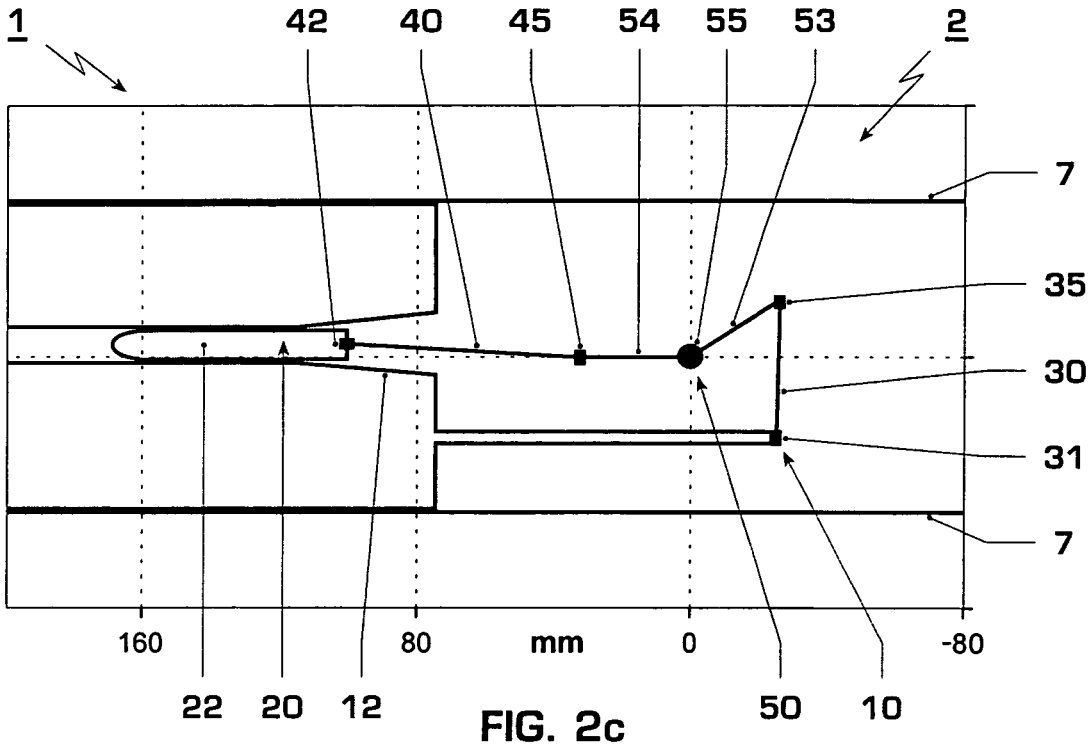

In FIG. 2*c*, the first contact piece 10 has been moved further to the left and the lever 50 has in consequence been rotated further counterclockwise. The output drive lever arm 54 and the output drive rod 40 are now slightly bent beyond the extended angle shown in FIG. 2*b*. The bent angle results in the second contact piece 20 once again being moved or shifted to the right away from the maximum deflection position.

The movement state illustrated in FIG. 2*b* therefore represents a dead point in the gear 2, to be more precise, a dead point of the output drive rod 40, or in other words a reversal point of the gear 2, or for the movement of the output drive rod 40. The dead point is an outer dead point between the output drive rod 40 and the output drive lever 54.

In FIG. 2*c*, the drive rod 30 and the switching axis 3 (or the center axis 3 of the concentric arcing contacts 12, 22) are at right angles. In consequence, the vertical deflection of the swiveling-joint 35 is a maximum, as shown in FIG. 2*c* as the maximum to the top. The further movement of the first contact piece 10 to the left, leading from FIG. 2*c* to FIG. 2*d*, reduces the vertical deflection of the swiveling-joint 35 once again, in contrast to the previous movement direction of the lever 50, the lever 50 is thus rotated clockwise during the transition from FIG. 2*c* to FIG. 2*d*. On passing through the maximum vertical deflection of the swiveling-joint 35, FIG. 2*c* therefore represents a reversal point for the movement of the lever 50 around the lever axis 56. FIG. 2*c* therefore also shows a dead point of the gear 2. However, the dead point in FIG. 2*c* is a dead point of a different type to the dead point in FIG. 2*b*. The dead point in FIG. 2*c* is firstly a dead point of a different gear part than the dead point in FIG. 2*b*; secondly it is not an outer dead point, but is governed by the angle of 90° between the input drive rod 30 and the switching axis 3, or the contact piece 10 moving along the switching axis 3.

The time offset between passing through the dead points shown in FIGS. 2*b* and 2*c* can be set by means of the angle between the input drive lever arm 53 and the output drive lever arm 54. It is proposed, therefore, independently of the illustrated embodiment, that the input drive lever arm 53 and the output drive lever arm 54 be bent. Independently of this, the bent angle can be chosen such that, during the movement of the first contact piece 10 in the first movement range, the dead point 62*c* and, if appropriate, the dead points 62*b* and/or 62*d* (FIG. 3*b*) are passed through at different times. The second contact piece 20 can move between two different dead points in each case.

Figure 2D:
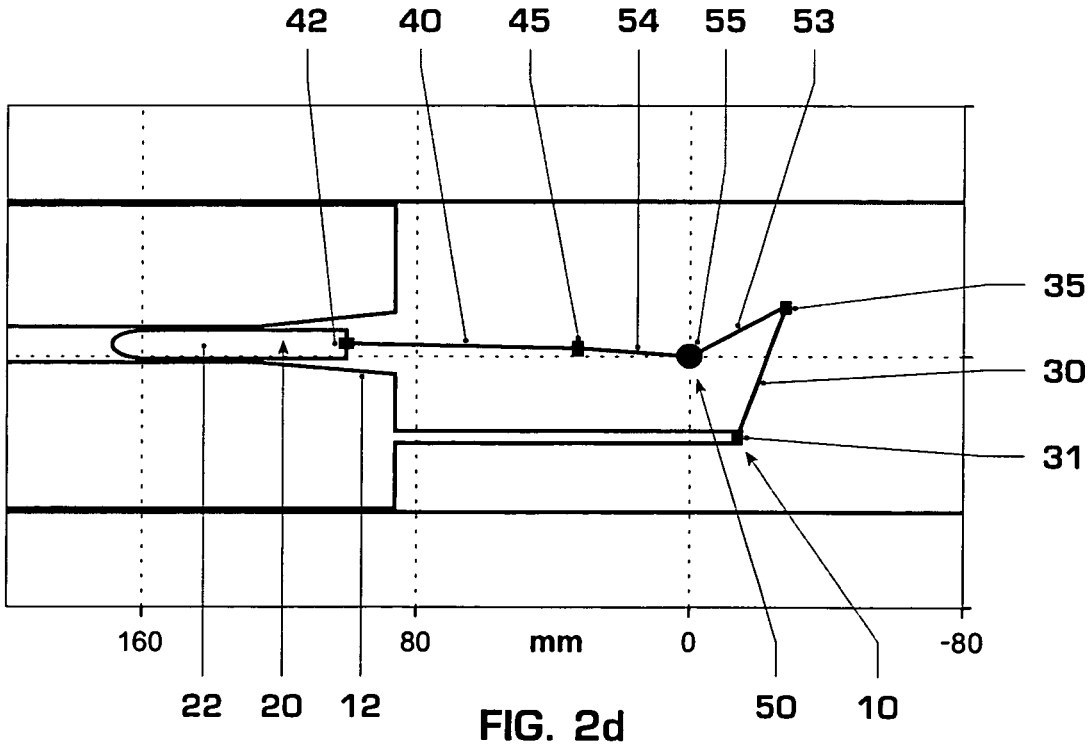

The rotation of the lever 50 in the clockwise direction, that leads from FIG. 2*c* to FIG. 2*d*, results in the output drive lever arm 54 and the output drive rod 40 in FIG. 2*d* once again forming the extended angle as already illustrated in FIG. 2*b*. The movement state illustrated in FIG. 2*d* therefore shows once again a dead point of the gear 2. The dead point is a dead point of the same type to the dead point illustrated in FIG. 2*b*, specifically an outer dead point between the output drive lever arm 54 and the output drive rod 40.

The dead points shown in FIGS. 2*b* and 2*d* are typically dead points of the output-drive-side part of the gear 2, irrespective of the illustrated embodiment, that is to say dead points of a gear part located on the output drive side of the lever axis 56, for example, of the swiveling-joint 45, which is articulated on the output drive lever arm 54. The dead points in FIG. 2*b* and FIG. 2*d* are typically dead points of the same type, i.e. inner or outer dead points of the same gear parts. They are outer dead points, i.e. dead points characterized by an angle of essentially 180° between, for example, the lever 50 and the output drive rod 40.

Irrespective of the illustrated embodiment, the dead point in FIG. 2*c* and the dead point in FIG. 2*b* or FIG. 2*d* are typically dead points of a different type, in particular of different parts of the gear 2, for example, of the input drive side part 10, 30, 35, 53 and of the output drive side part 54, 45, 40, 20 of the gear 2. These parts of the gear may be the respective swiveling-joints 35, 45, which are provided at the input drive end or on the input drive lever arm 53, or at the output drive end or on the output drive lever arm 54, of the lever 50 as articulation points for the bars, piston or connecting rods or connecting levers 30, 40.

Figure 2E:
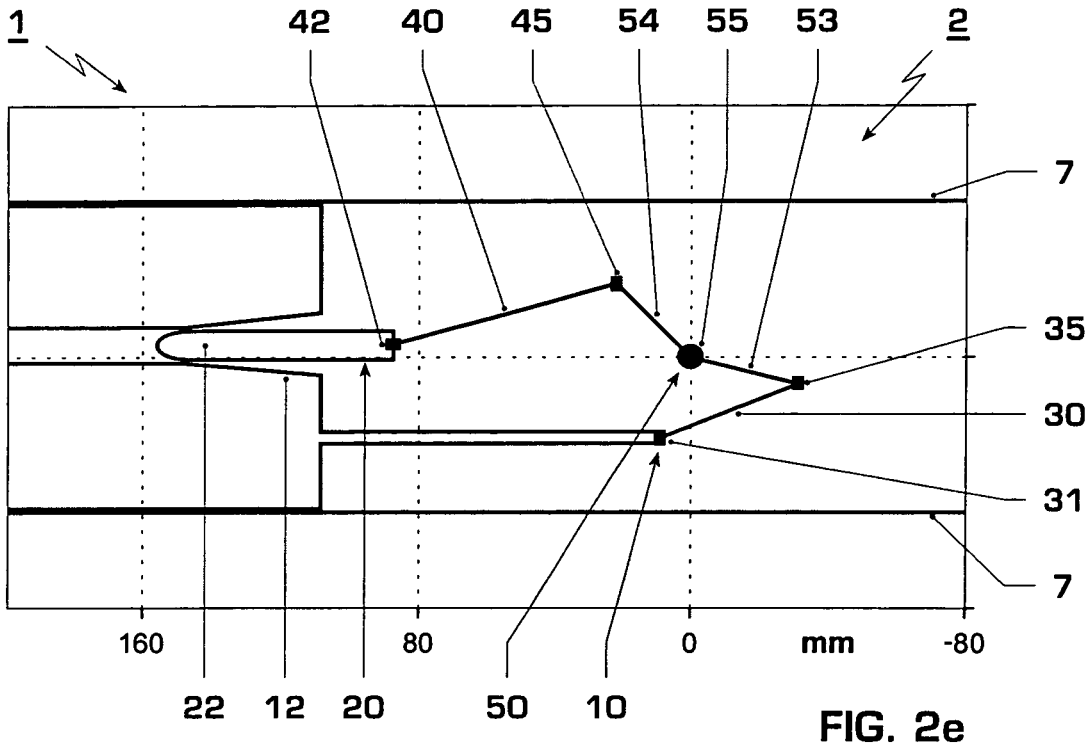

In FIG. 2*e*, the first contact piece 10 has been moved further to the left, and the lever 50 has in consequence been rotated further clockwise. In consequence, the second contact piece 20 has been moved to the right so that the first arcing contact 12 has been disconnected from the second arcing contact 22. The mechanical and direct electrical contact between the arcing contacts 12, 22 has thus been disconnected. An arc is generally struck after disconnection and can be quenched by means of a suitable quenching gas apparatus for the circuit breaker 1.

Figure 2F:
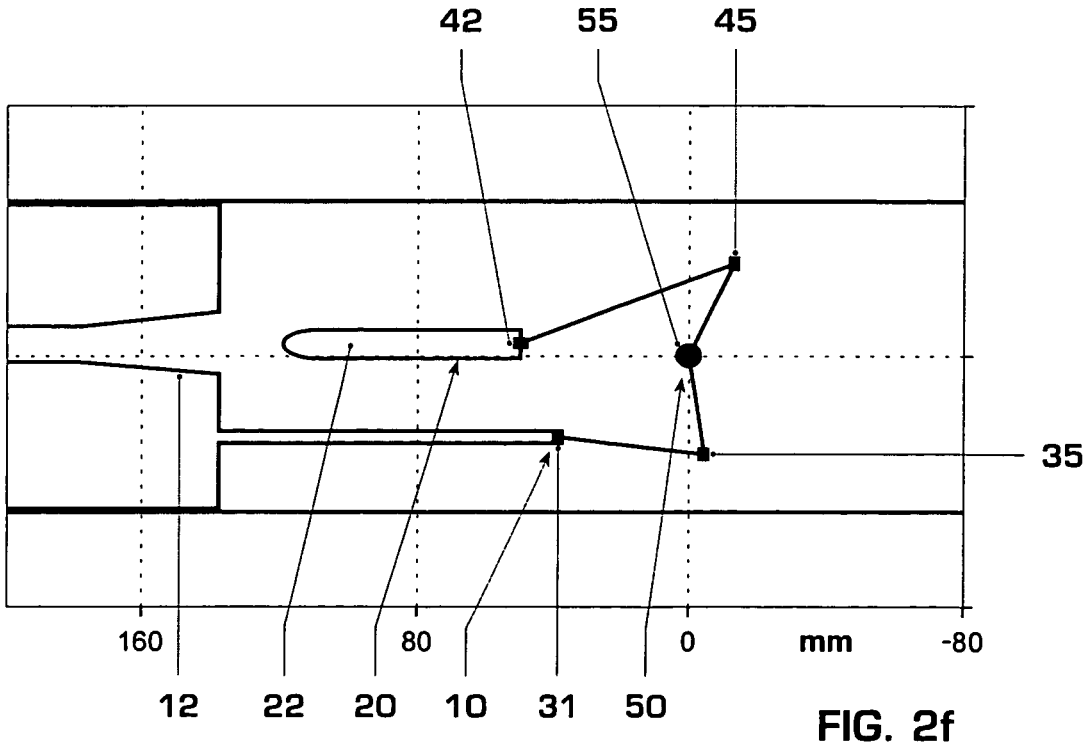

In FIG. 2*f*, the first contact piece 10 has been moved to the left-hand edge of the first movement range. In consequence, the lever 50 has been rotated further clockwise. This results in the second contact piece 20 having been moved to the right-hand edge of the second movement range. The first arcing contact 12 and the second arcing contact 22 have thus been disconnected from one another to the maximum distance and the contacts on the circuit breaker 1 have been opened.

FIG. 3*a* to FIG. 3*d* show movement, speed, and acceleration diagrams for the first contact piece 10 and the second contact piece 20 during the contact-opening movement of the circuit breaker 1, as illustrated in FIG. 2*a* to 2*f*. In these diagrams, the horizontal axis represents the deflection of the first contact piece 10 along its movement range along the switching axis 3. The movement curve 61 of the first contact piece 10 is therefore, by definition, a straight line. The left-hand and right-hand edge of the horizontal axis correspond to the edge of the movement range of the first contact piece 10 with the switch 1 being closed and open, respectively.

If the movement of the first contact piece 10 is approximated as a movement at a constant speed, the horizontal axis can also be regarded as a time axis, as shown by the inscription of FIGS. 3*a* to 3*d*. This approximation can be valid after the end of a brief initial drive acceleration phase during which the first contact piece is accelerated to the essentially constant speed. The point from which the corresponding contact piece is accelerated to about 50% of its maximum speed can be set as the point for the end of the input-drive or output-drive acceleration phase. This point is followed by a movement phase of the corresponding contact piece which can be characterized by an essentially constant speed that is to say a speed which is constant with a tolerance of up to 50%.

Figure 3A:
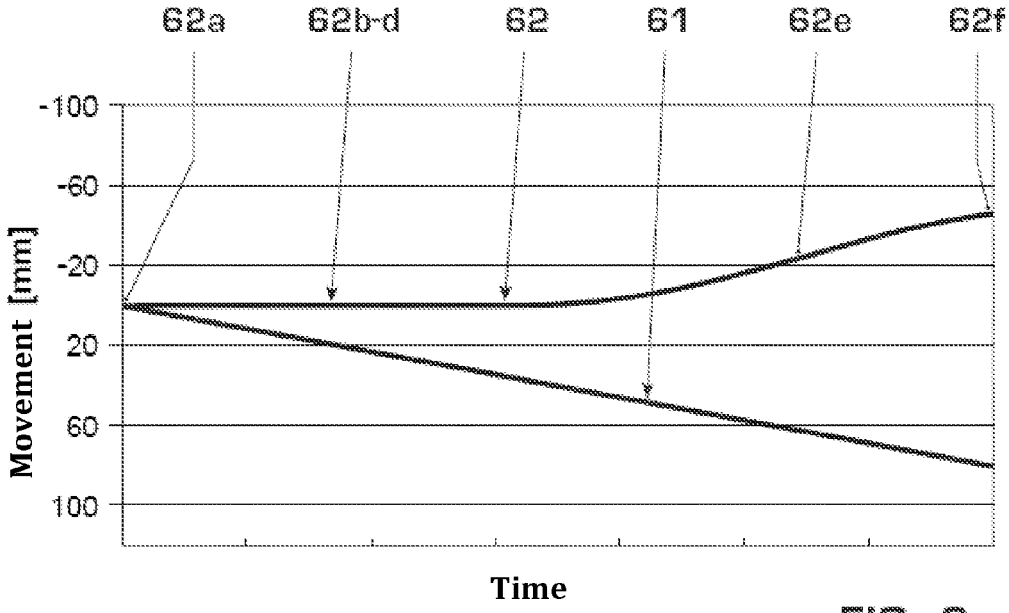
FIGS. 3*a*-3*d* movement, speed and acceleration diagrams during the opening of the contacts of the circuit breaker illustrated in FIGS. 2*a*-2*f;*
Figure 3B:
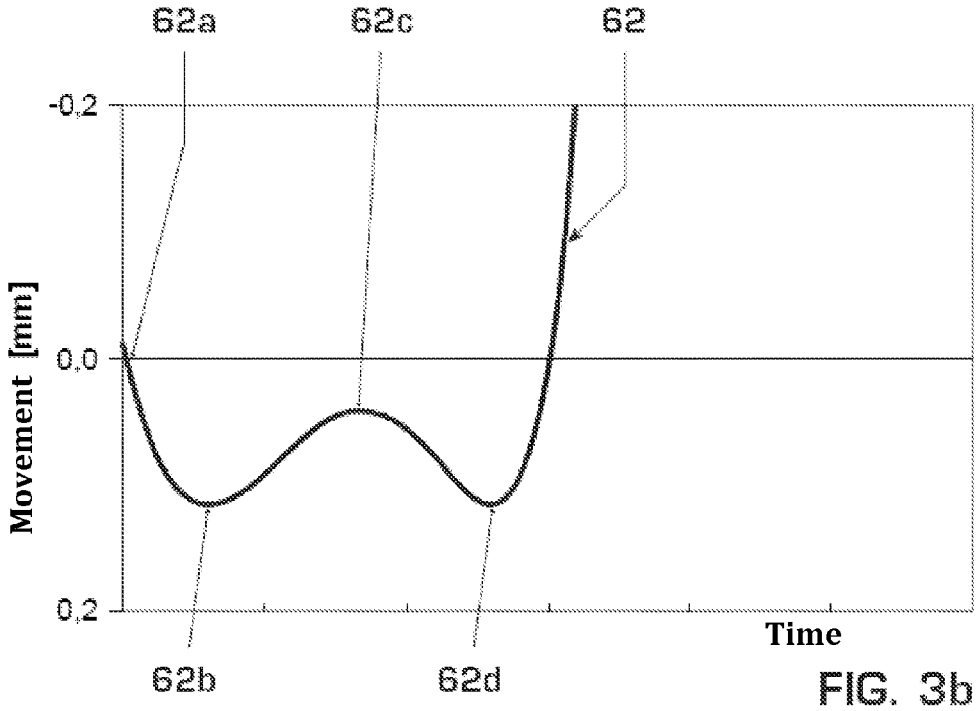

The points 62*a* to 62*f* on the movement curve 62 in FIGS. 3*a* and 3*b* respectively correspond to the gear states illustrated in FIGS. 2*a* to 2*f*. The movement curve 62 in FIG. 3*a* shows the reflection of the second contact piece 20 is virtually constant in an initial phase (part of the movement curve 62*a-d*) and that the second contact piece 20 is thus initially virtually stationary. Only after this initial phase, which can be referred to as an initial acceleration phase, is the second contact piece 20 visibly accelerated.

FIG. 3*b* shows a detail of the movement of the second contact piece 20 on a much greater scale. On this scale, the movement of the second contact piece 20 also can be seen during its initial acceleration phase. The movement is characterized by three direction changes 62*b*, 62*c* and 62*d*, which are caused by the dead points (reversal points) respectively shown in FIGS. 2*b*, 2*c* and 2*d*. Since the three dead points described, specifically the first dead point 62*b*, the second dead point 62*c* and the third dead point 62*d*, are passed through, this ensures that the second contact piece 20 is subjected to the low acceleration illustrated in FIG. 3*a* during the initial acceleration phase. The point 62*d* can therefore be regarded as the end of the initial acceleration phase of the second contact piece 20, at this point the third or last dead point being passed through, during which the circuit breaker 1 is still closed.

The initial acceleration phase of the second contact piece 20 allows the acceleration phase of the first contact piece 10 to be separated in time from the acceleration phase of the second contact piece 20. This is feasible provided the acceleration phase of the second contact piece 20 starts only after the end of the acceleration phase of the first contact piece 10. This makes it possible to avoid that the input drive for the first contact piece 10 has to accelerate two contact pieces 10, 20 sharply at the same time, thus allowing the acceleration energy of the drive to be used more advantageously. At the same time, during closing of the switch 1, that is to say during the opposite movement, the relative movement of the contact pieces 10, 20 can be decelerated more smoothly, thus making it possible to reduce the material wear on the contact pieces 10, 20.

The acceleration can also be increased by shortening the acceleration phase. The reduced deflection of the second contact piece 20 during the initial acceleration phase also results in a reduction in the movement range required to switch the second contact piece 20, thus making it possible to produce the circuit breaker in a physically more compact manner.

As shown in FIG. 2*e*, the arcing contacts 12, 22 are disconnected only during, or even after, the end of the acceleration phase of the second contact piece 20. This makes it possible to ensure that the relative speed of the contact pieces 10, 20 is high during the disconnection of the electrical contact. In consequence, any arc that is struck during this disconnection process is extended quickly and thus can be quenched more easily.

Figure 3C:
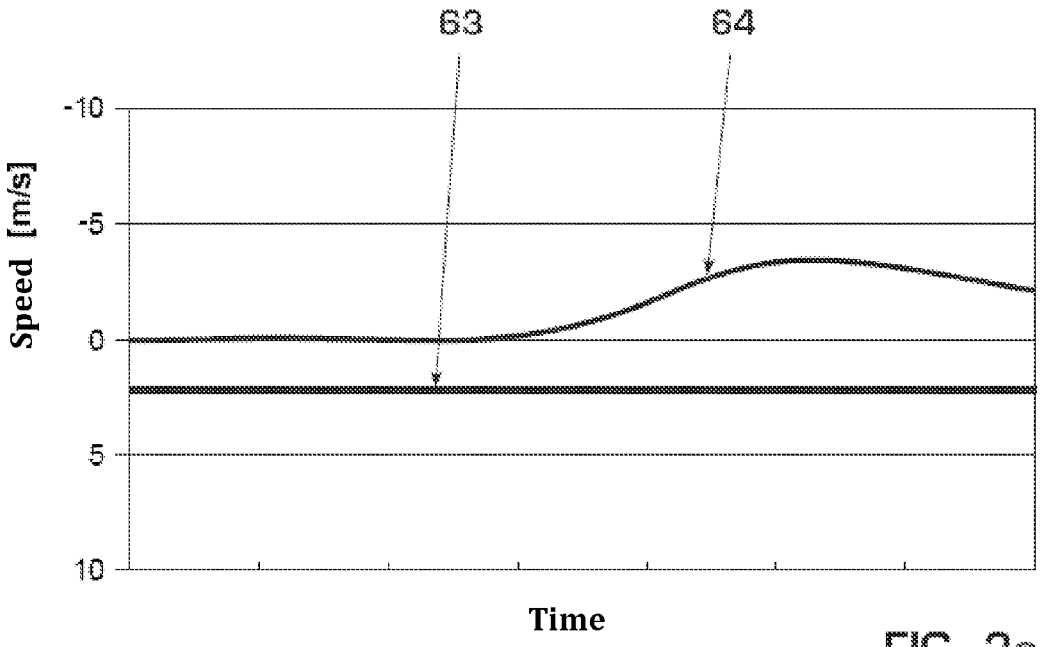
Figure 3D:
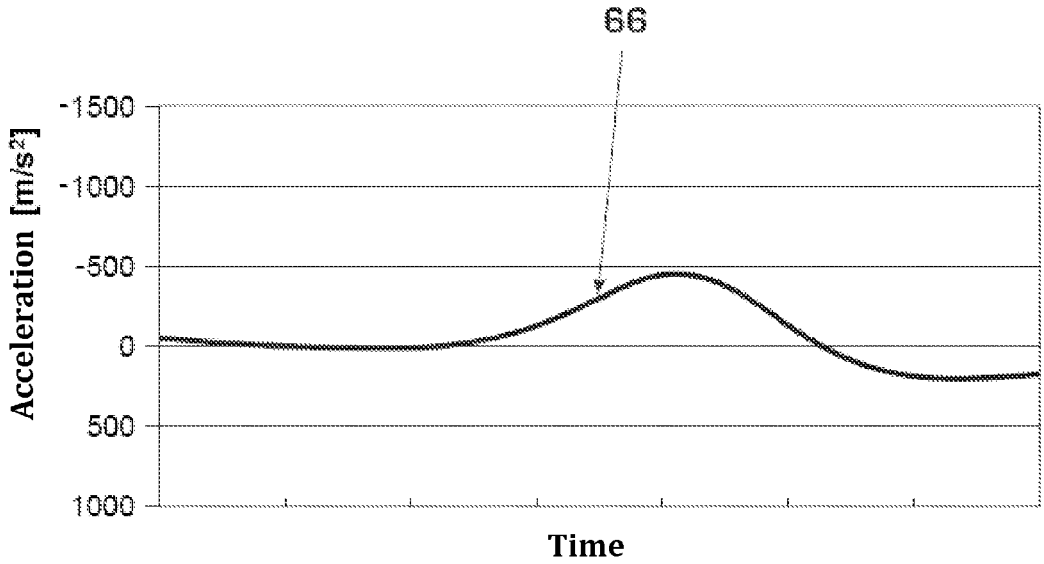
Figure 4A:
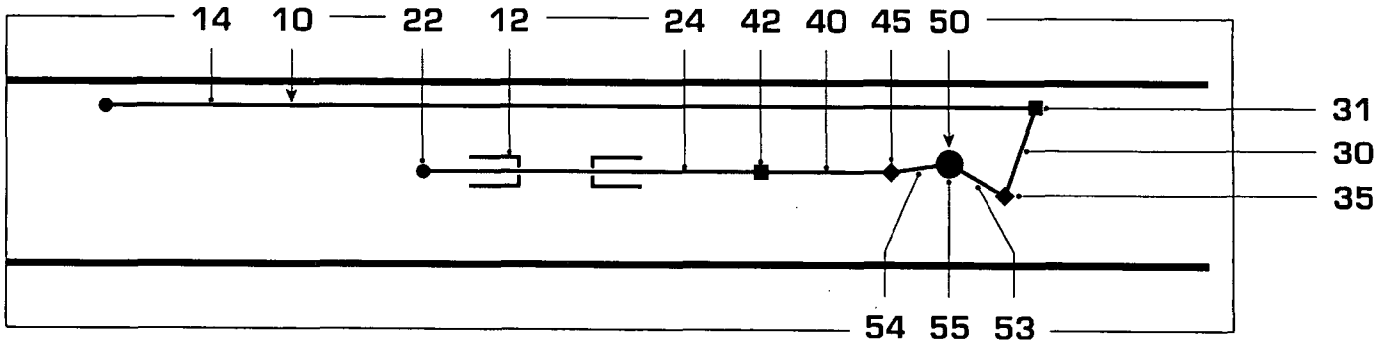
FIGS. 4*a*-4*f* movement states during the opening of the contacts of a further circuit breaker according to the disclosure.
Figure 4B:
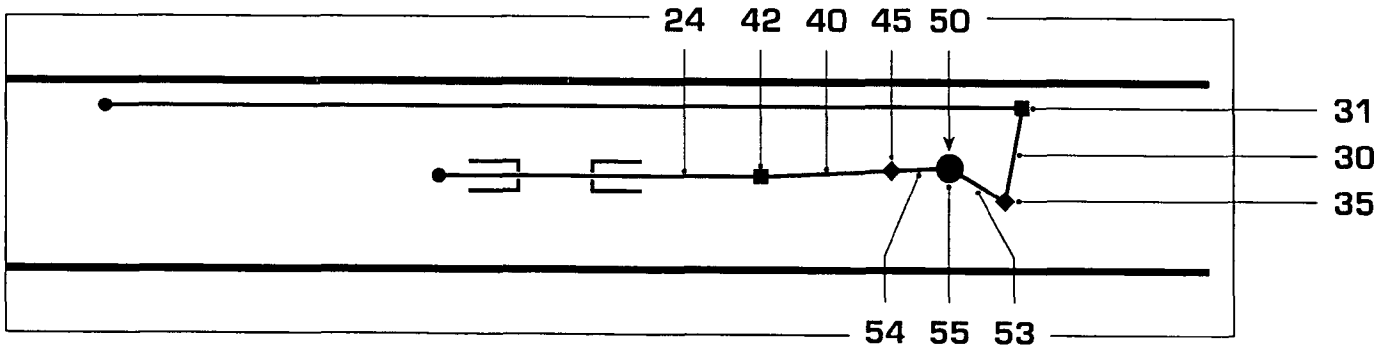
Figure 4C:
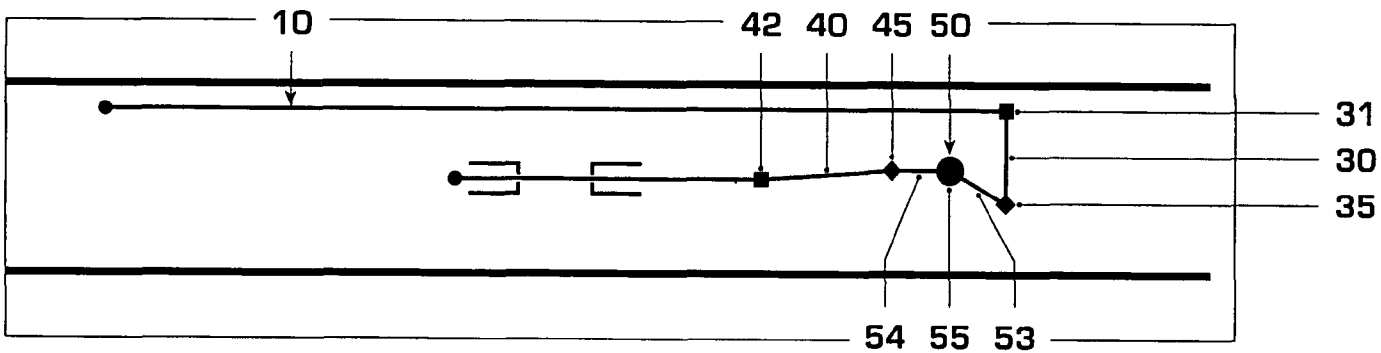
Figure 4D:
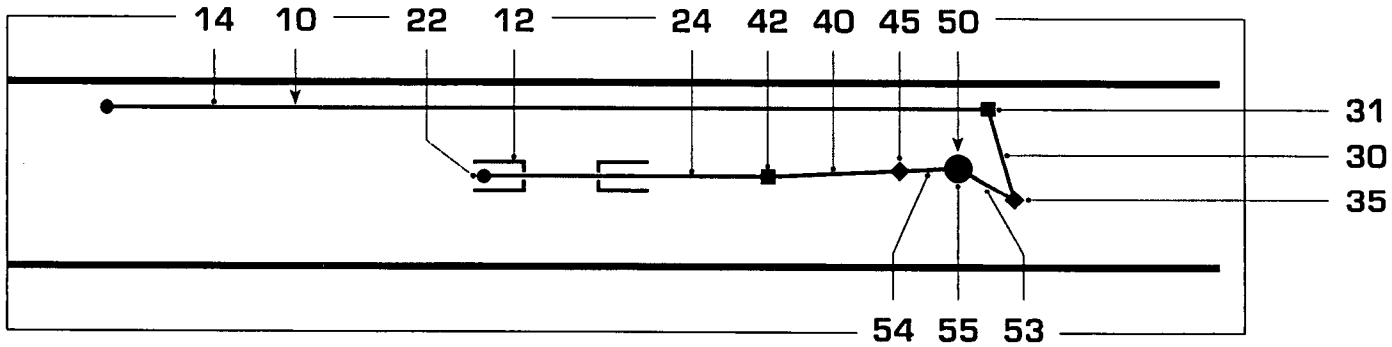
Figure 4E:
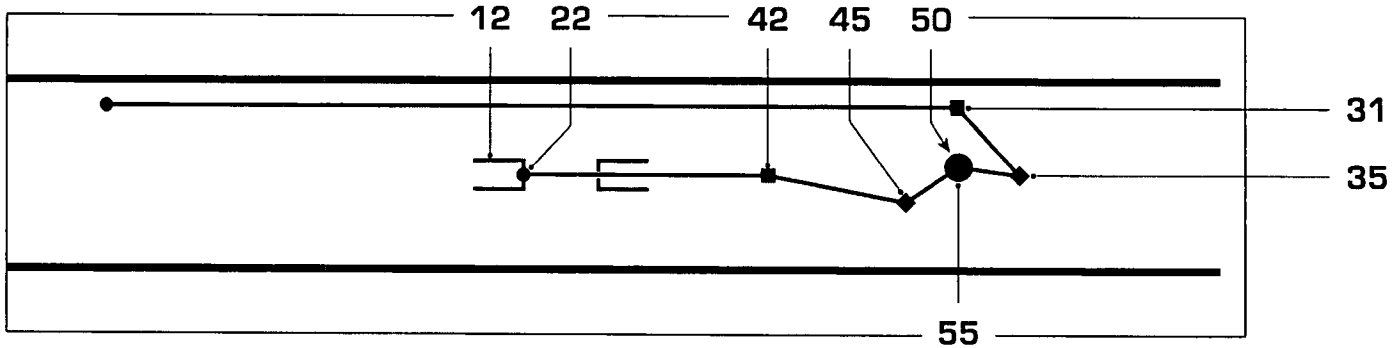
Figure 4F:
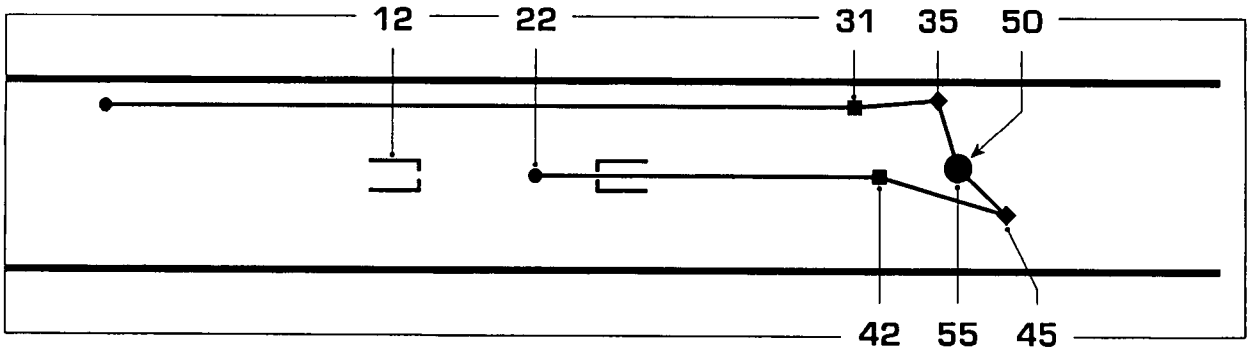

FIG. 3*c* shows the speed curves 63 of the first contact piece 10 and 64 of the second contact piece 20, i.e. the first derivatives of the respective movement curves 61 and 62 in FIG. 3*a*. FIG. 3*d* shows the acceleration curve 66 of the second contact piece 20, i.e. the second derivative of the movement curve 62 in FIG. 3*a*.

The final position of the switch 1 for the switching state 62*a* (see FIG. 3*b*) in which the contacts are closed may be varied without departing from the disclosure. In particular, the final position may be chosen as any desired point before the final reversal point 62*d*. In this case, the final position of the switch 1 for the closed switching state can be associated with a gear state which is closer to the dead point 62*b* than to the dead point 62*c*. In this case, the expression close is defined on the basis of the distance on the horizontal axis of the movement diagram, for example, from FIG. 3*b*, that is to say on the basis of the physical length of an actual or imaginary movement of the first contact piece 10 along the switching axis 3.

Irrespective of the illustrated embodiment, the movement which can be transferred by the gear 2 is typically a movement for opening the contacts of the switch 1. The gear 2 is typically designed such that, during the movement to disconnect the switch 1, the dead point 62*d* is passed through after the dead point 62*c*, and/or such that the dead point 62*c* is passed through after the dead point 62*b*. The arcing contacts 12, 22 can be arranged, and the gear 2 can be designed such that, during the movement to open the contacts of the switch 1, the arcing contacts 12, 22 are disconnected only after the dead point 62*c* has been passed through, and, if appropriate once the dead point 62*d* and/or if appropriate, the dead point 62*d* have been passed through.

The typical asymmetric configuration of the gear can be characterized by one or more of the following further conditions for asymmetry, which may each be satisfied individually irrespective of the illustrated embodiments:

the gear provides input-drive-side and output-drive-side dead points which are separate from one another. In particular, the gear is designed such that, when the first contact piece is in a movement state in the first movement range, the output drive rod or a swiveling-joint of the output drive rod passes through a dead point, while the input drive rod or a swiveling-joint of the input drive rod does not pass through any dead point; or alternatively, such that the input drive rod or a swiveling-joint of the input drive rod passes through a dead point, while the output drive rod or a swiveling-joint of the output drive rod does not pass through a dead point.

the gear is designed such that, during the movement of the first contact piece in the first movement range, the output drive rod or a swiveling-joint of the output drive rod passes through a dead point of a different type than the input drive rod or a swiveling-joint of the input drive rod; or else such that the drive rod or a swiveling-joint of the drive rod passes through a dead point of a different type than the output drive rod or a swiveling-joint of the output drive rod; or the transmission ratio of the gear is non-linear.

FIG. 4*a* to FIG. 4*f* show movement states during the opening of the contacts of a further circuit breaker according to the disclosure. In this case, the same reference symbols refer to identical or functionally similar parts to those in the previous figures. The geometry and the arrangement of the gear parts illustrated in FIG. 4*a* to FIG. 4*f* differ slightly from the geometry and arrangement illustrated in FIG. 2*a* to FIG. 2*f*. Nevertheless, the description relating to FIGS. 2*a* to 2*f* applies in an essentially analogous manner here.

Figure 5A:
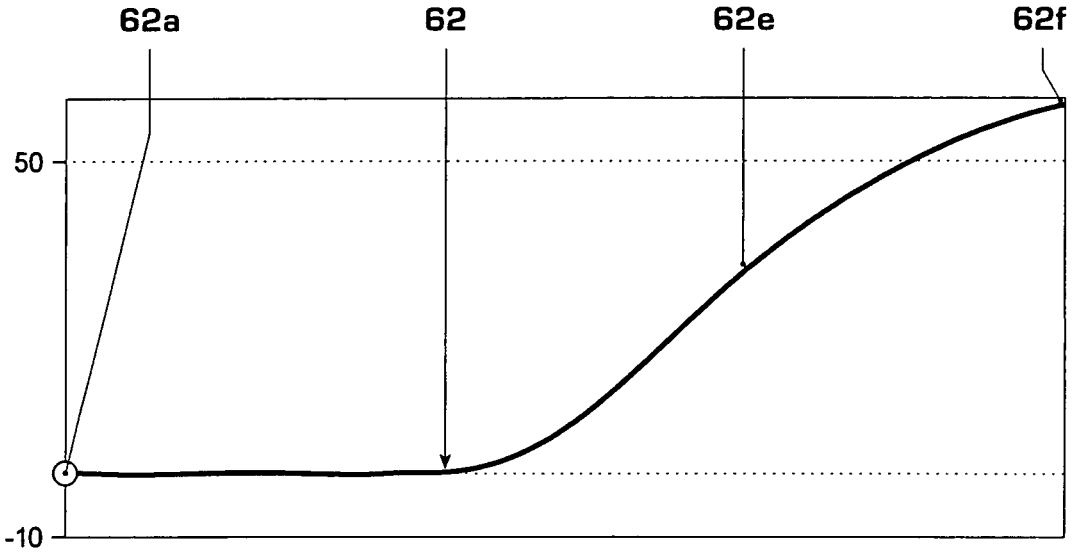
FIGS. 5*a*-5*c* movement and speed diagrams during the opening of the contacts of the circuit breaker illustrated in FIGS. 4*a*-4*f.*
Figure 5B:
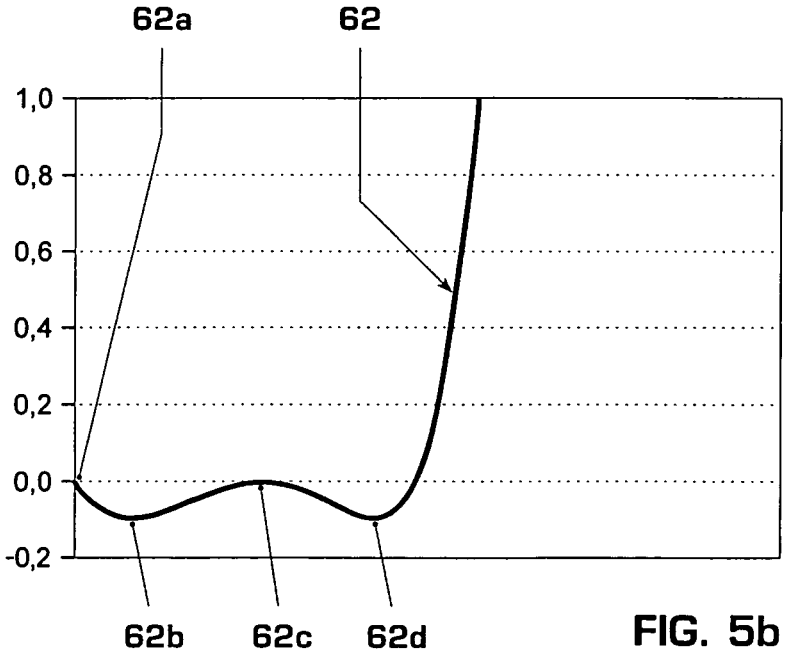
Figure 5C:
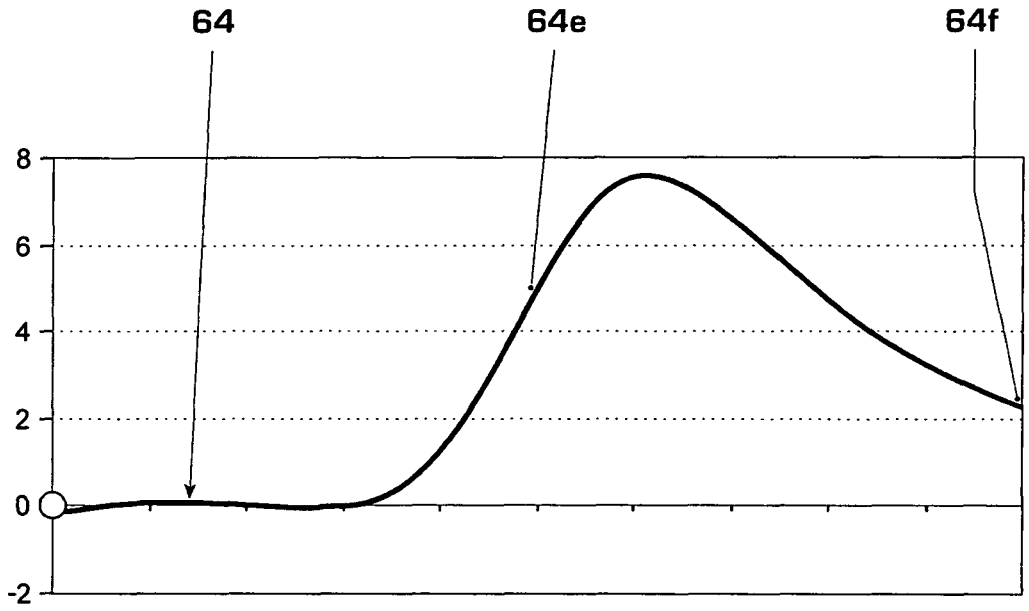

FIG. 5*a* and FIG. 5*b* show the movement diagram for the output drive side (analogous to FIG. 3*a* and FIG. 3*b*) and FIG. 5*c* shows the speed diagram for the output drive side (analogous to FIG. 3*c*) during the opening of the contacts of the circuit breaker illustrated in FIG. 4*a* to FIG. 4*f*. 64*e* denotes an acceleration phase, and 64*f* the final speed of the second contact piece 20. The description related to FIGS. 3*a* to 3*c* also applies in an essentially corresponding manner to these figures.

The first input-drive-side contact piece 10 is connected to the (not illustrated) insulating material nozzle of the circuit breaker 1 and is driven by it.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SYMBOLS

| | |
|---|---|
| 1 | Circuit breaker |
| 2 | Gear, transmission |
| 3 | Centre axis, switching axis |
| 7 | Enclosure |
| 10 | First contact piece |
| 12 | First arcing contact/tulip |
| 14 | First sliding element |
| 15 | Coupling |
| 16 | Rail |
| 20 | Second contact piece |
| 22 | Second arcing contact/pin |
| 24 | Second sliding element |
| 25 | Coupling |
| 26 | Rail |
| 30 | Drive rod, Input drive rod, drive connecting rod |
| 31 | Swiveling-joint, swivel joint 30-10 |
| 35 | Swiveling-joint, swivel joint 30-50 |
| 40 | Driven rod, output drive rod, output drive connecting rod |
| 42 | Swiveling-joint, swivel joint 40-20 |
| 45 | Swiveling-joint, swivel joint 40-50 |
| 50 | Two-armed lever |
| 53 | Input drive lever arm |
| 54 | Output drive lever arm |
| 55 | Lever articulation |
| 56 | Lever axis |
| 61 | Movement curve of the first contact piece |
| 62 | Movement curve of the second contact piece |
| 62a-f | Points on the movement curve which correspond to the states in FIGS. 2a-2f |
| 63 | Speed curve of the first contact piece |
| 64 | Speed curve of the second contact piece |
| 64e | Acceleration phase of the second contact piece |
| 64f | Final speed of the second contact piece |
| 66 | Acceleration curve of the second contact piece |

What is claimed is:

1. An electrical circuit breaker comprising:

a first contact piece including a first arcing contact;

a second contact piece including a second arcing contact;

a drive configured to move the first contact piece in a first movement range along a switching axis; and a gear configured to transfer the movement of the first contact piece to a movement of the second contact piece, the first movement range comprising a contact-subrange and a disconnecting-subrange in which the arcing contacts make contact with one another when the first contact piece is in the contact-subrange, and the arcing contacts are disconnected from one another when the first contact piece is in the disconnecting-subrange, the second contact piece passes through a first dead point in which the second contact piece reverses directions during at least one of an opening stroke and a closing stroke while the first contact piece is moving in the contact-subrange.

2. The electrical circuit breaker as claimed in claim 1, wherein:

the gear comprises an input drive rod, an output drive rod and a lever, which is configured to pivot about a lever axis and has an input drive lever arm and an output drive lever arm, the input drive rod is articulated on the first contact piece such that the input drive rod is configured to rotate by means of a swiveling-joint and is articulated on the input drive lever arm such that the input drive rod is configured to rotate by means of a further swiveling-joint; and the output drive rod is articulated on the second contact piece such that the output drive rod is configured to rotate by means of a swiveling-joint and is articulated on the output drive lever arm such that the output drive rod is configured to rotate by means of a further swiveling-joint.

3. The electrical circuit breaker as claimed in claim 2, wherein the input drive lever arm and the output drive lever arm form a bent angle.

4. The electrical circuit breaker as claimed in claim 1, wherein the first arcing contact and the second arcing contact are arranged coaxially around the switching axis, and wherein a lever axis is arranged radially offset with respect to the switching axis.

5. The electrical circuit breaker as claimed in claim 2, wherein the first dead point is a reversal point for the pivoting movement of the lever around the lever axis.

6. The electrical circuit breaker as claimed in claim 2, wherein the first dead point is characterized by the input drive rod and the switching axis being essentially at a right angle.

7. The electrical circuit breaker as claimed in claim 1, wherein the gear has a second dead point which is passed through during the movement of the first contact piece in the first movement range.

8. The electrical circuit breaker as claimed in claim 1, wherein the gear has a third dead point, which is passed through during the movement of the first contact piece in the first movement range.

9. The electrical circuit breaker as claimed in claim 8, wherein the gear has a second dead point which is passed through during the movement of the first contact piece in the first movement range, and wherein at least one of the second dead point and the third dead point is a dead point of a part of the gear on the output drive side with respect to the lever axis.

10. The electrical circuit breaker as claimed in claim 8, wherein the gear has a second dead point which is passed through during the movement of the first contact piece in the first movement range, and wherein at least one of the second dead point and the third dead point is a dead point of the swiveling-joint on the output drive lever arm, or an outer dead point.

11. The electrical circuit breaker as claimed in claim 7, wherein the gear has a third dead point, which is passed through during the movement of the first contact piece in the first movement range, and wherein the gear is configured such that, during the movement of the first contact piece in the first movement range, at least one of the first, the second and the third dead points are passed through separately from one another.

12. The electrical circuit breaker as claimed in claim 8, wherein the gear has a second dead point which is passed through during the movement of the first contact piece in the first movement range, and wherein at least one of the second and the third dead points is passed through during the movement of the first contact piece in the contact-subrange.

13. A method for contact disconnection of an electrical circuit breaker, which has a first contact piece including a first contact, a second contact piece including a second contact, a gear, and a circuit breaker as claimed in claim 1, wherein the method comprises the following steps:

moving the first contact piece in a disconnection direction along a switching axis;

transferring, via the gear, the movement of the first contact piece to a movement of the second contact piece along the switching axis; and disconnecting the first contact and the second contact from one another by the movement of the contact pieces, wherein the movement of the second contact piece changes direction at least once before disconnection of the contacts.

14. The method as claimed in claim 13, wherein the movement of the first contact piece comprises an acceleration phase followed by a movement phase, the movement of the second contact piece comprises an initial acceleration phase followed by an acceleration phase, and the initial acceleration phase of the second contact piece comprises the at least one direction change of the movement of the second contact piece.

15. The method as claimed in claim 14, wherein the acceleration phase of the second contact piece starts only after the end of the acceleration phase of the first contact piece.

16. The method as claimed in claim 14, wherein the contacts are disconnected from one another after the end of the initial acceleration phase of the second contact piece.

17. The method as claimed in claim 14, wherein arcing contacts are disconnected from one another before the end of the acceleration phase of second contact piece.

18. The electrical circuit breaker as claimed in claim 2, wherein the first arcing contact and the second arcing contact are arranged coaxially around the switching axis, and the lever axis is arranged radially offset with respect to the switching axis.

19. The electrical circuit breaker as claimed in claim 3, wherein the first arcing contact and the second arcing contact are arranged coaxially around the switching axis, and the lever axis is arranged radially offset with respect to the switching axis.

20. The electrical circuit breaker as claimed in claim 3, wherein the first dead point is a reversal point for the pivoting movement of the lever around the lever axis.

21. The electrical circuit breaker as claimed in claim 4, wherein the first dead point is a reversal point for the pivoting movement of the lever around the lever axis.

22. The electrical circuit breaker as claimed in claim 3, wherein the first dead point is characterized by the input drive rod and the switching axis being essentially at a right angle.

23. The electrical circuit breaker as claimed in claim 4, wherein the first dead point is characterized by the input drive rod and the switching axis being essentially at a right angle.

24. The electrical circuit breaker as claimed in claim 5, wherein the first dead point is characterized by the input drive rod and the switching axis being essentially at a right angle.

25. The electrical circuit breaker as claimed in claim 2, wherein the gear has a second dead point which is passed through during the movement of the first contact piece in the first movement range.

26. The electrical circuit breaker as claimed in claim 3, wherein the gear has a second dead point which is passed through during the movement of the first contact piece in the first movement range.

27. The electrical circuit breaker as claimed in claim 4, wherein the gear has a second dead point which is passed through during the movement of the first contact piece in the first movement range.

28. The electrical circuit breaker as claimed in claim 5, wherein the gear has a second dead point which is passed through during the movement of the first contact piece in the first movement range.

29. The electrical circuit breaker as claimed in claim 6, wherein the gear has a second dead point which is passed through during the movement of the first contact piece in the first movement range.

30. The electrical circuit breaker as claimed in claim 2, wherein the gear has a third dead point, which is passed through during the movement of the first contact piece in the first movement range.

31. The electrical circuit breaker as claimed in claim 3, wherein the gear has a third dead point, which is passed through during the movement of the first contact piece in the first movement range.

32. The electrical circuit breaker as claimed in claim 4, wherein the gear has a third dead point, which is passed through during the movement of the first contact piece in the first movement range.

33. The electrical circuit breaker as claimed in claim 5, wherein the gear has a third dead point, which is passed through during the movement of the first contact piece in the first movement range.

34. The electrical circuit breaker as claimed in claim 6, wherein the gear has a third dead point, which is passed through during the movement of the first contact piece in the first movement range.

35. The electrical circuit breaker as claimed in claim 7, wherein the gear has a third dead point, which is passed through during the movement of the first contact piece in the first movement range.

36. The electrical circuit breaker as claimed in claim 9, wherein at least one of the second and the third dead points is passed through during the movement of the first contact piece in the contact-subrange.

37. The electrical circuit breaker as claimed in claim 10, wherein at least one of the second and the third dead points is passed through during the movement of the first contact piece in the contact-subrange.

38. The electrical circuit breaker as claimed in claim 11, wherein at least one of the second and the third dead points is passed through during the movement of the first contact piece in the contact-subrange.

39. The electrical circuit breaker as claimed in claim 1, wherein the lever of the gear is a two-armed lever.

40. A procedure for contact disconnection of an electrical circuit breaker, which has a first contact piece with a first contact, a second contact piece with a second contact and a gear, the procedure comprising the following mechanical movements:

moving the first contact piece in a disconnection direction along a switching axis;

the gear transferring the movement of the first contact piece to a movement of the second contact piece along the switching axis; and disconnecting the first contact and the second contact from one another by the movement of the contact pieces, wherein the movement of the second contact piece changes direction for disconnecting the contacts, and wherein the second contact piece passes through a first dead point in which the second contact piece reverses directions during at least one of an opening stroke and a closing stroke while the first contact of the first contact piece and the second contact of the second contact piece make contact with each other.

* * * * *